US010641038B2

(12) United States Patent
Franssen

(10) Patent No.: US 10,641,038 B2
(45) Date of Patent: May 5, 2020

(54) RAIL FOR AN ARCHITECTURAL OPENING COVERING

(71) Applicant: Hunter Douglas Industries B.V., Rotterdam (NL)

(72) Inventor: Johannes Robertus Maria Franssen, Breda (NL)

(73) Assignee: HUNTER DOUGLAS INDUSTRIES B.V., Rotterdam (NL)

( * ) Notice: Subject to any disclaimer, the term of this patent is extended or adjusted under 35 U.S.C. 154(b) by 222 days.

(21) Appl. No.: 15/822,258

(22) Filed: Nov. 27, 2017

(65) Prior Publication Data

US 2018/0155983 A1 Jun. 7, 2018

(30) Foreign Application Priority Data

Dec. 1, 2016 (EP) ..... 16201779

(51) Int. Cl.

| | |
|---|---|
| ***E06B 9/327*** | (2006.01) |
| ***E06B 9/388*** | (2006.01) |
| ***E06B 9/42*** | (2006.01) |
| ***E06B 9/322*** | (2006.01) |

(52) U.S. Cl.

CPC ..... *E06B 9/327* (2013.01); *E06B 9/388* (2013.01); *E06B 9/42* (2013.01); *E06B 2009/3222* (2013.01)

(58) Field of Classification Search

CPC . E06B 9/327; E06B 9/42; E06B 9/388; E06B 2009/3222

USPC ..... 160/330, 332, 370, 371, 379

See application file for complete search history.

(56) References Cited

U.S. PATENT DOCUMENTS

| | | | | |
|---|---|---|---|---|
| 4,842,034 | A * | 6/1989 | Haines | B60J 1/2091 160/84.04 |
| 2003/0075285 | A1 | 4/2003 | Anderson et al. | |
| 2004/0074611 | A1* | 4/2004 | Colson | E06B 9/262 160/84.05 |
| 2005/0092446 | A1 | 5/2005 | Ni | |
| 2015/0275571 | A1* | 10/2015 | Guhl | E06B 9/327 160/172 R |

FOREIGN PATENT DOCUMENTS

| | | | |
|---|---|---|---|
| CN | 2862889 | Y † | 1/2007 |
| DE | 202007000136 | U1 † | 6/2007 |
| DE | 102011053648 | A1 † | 3/2013 |
| DE | 202015105004 | U1 | 1/2016 |
| DE | 102014018562 | A1 † | 6/2016 |
| EP | 0693611 | B1 † | 8/1998 |
| EP | 1696099 | A1 † | 8/2006 |
| EP | 2216482 | A2 † | 8/2010 |
| WO | 2009122222 | A1 | 10/2009 |

OTHER PUBLICATIONS

EP Search Report dated Oct. 24, 2018.

* cited by examiner
† cited by third party

*Primary Examiner* — Justin V Lewis

(57) ABSTRACT

A rail for use as a movable rail in an architectural structure covering is disclosed. The rail may include a cord guiding insert for mounting at an end of the rail.

19 Claims, 12 Drawing Sheets

RAIL FOR AN ARCHITECTURAL OPENING COVERING

CROSS-REFERENCE TO RELATED APPLICATIONS

This application claims priority to pending E.P. Patent Application Serial No. 16201779.2, filed Dec. 1, 2016, titled "Rail for an Architectural Opening Covering," the entirety of which application is incorporated by reference herein.

The following relates to a rail for use as a movable rail in an architectural structure covering, in particular including a cord guiding insert for mounting at an end of the rail.

It is known, for example from EP 1 526 246 A, to provide an architectural covering having a shade which is extendable over or retractable from the architectural structure. The shade may extend from a fixed portion at one side of the structure to a movable rail or it may be extendable between two respective movable rails, each movable with respect to the structure. In order to guide a respective movable rail, cords may be provided which extend through the movable rail and along the edges of the structure along which the movable rail moves. Also, magnetic plates may be provided at the side of the structure to which the movable rail may be moved so as to ensure that the movable rail fully closes against that side.

There may be provided a rail for use as a movable rail in an architectural covering wherein the rail includes a first end, wherein the rail extends in a first direction from the first end and wherein the rail includes a cord guiding insert for mounting at the first end. At the first end, the rail may have a cross-section with an inner profile shape defining an entrance into the rail. The rail may define an inner space extending in the first direction from the entrance and for receiving a cord. The cord guiding insert may include a base with an outer surface and an inner surface opposite to the outer surface. The cord guiding insert may include at least one insert portion extending from the inner surface of the base. The at least one insert portion may have an outer shape matching at least part of the inner profile shape of the first end. The cord guiding insert may be mounted at the first end with the at least one insert portion inserted into the entrance with the outer shape of the at least one insert portion fitting with the at least part of the inner profile shape to engage the cord guiding insert to the first end. The cord guiding insert may define a cord opening extending into the entrance. The rail may include a retention member having magnetic material for securing magnetically the rail to an end stop of the architectural covering. The cord guiding insert and the retention member may form a single unit mounted at the first end.

The base may be configured, with the cord guiding insert mounted at the first end and with the at least one insert portion inserted into the entrance, partially to close the entrance to define a cord opening between a first side of the base and the inner profile shape. The outer surface of the base may define a channel extending from the first side of the base to an opposite second side of the base whereby, with the cord guiding insert engaged to the first end, a cord may be guided out of the inner space, through the cord opening and along the channel defined by the outer surface of the base.

Thus, there may also be provided a rail for use as a movable rail in an architectural covering wherein the rail includes a first end, wherein the rail extends in a first direction from the first end and wherein the rail includes a cord guiding insert for mounting at the first end. At the first end, the rail may have a cross-section with an inner profile shape defining an entrance into the rail. The rail may define an inner space extending in the first direction from the entrance and for receiving a cord. The cord guiding insert may include a base with an outer surface and an inner surface opposite to the outer surface. The cord guiding insert may include at least one insert portion extending from the inner surface of the base. The at least one insert portion may have an outer shape matching at least part of the inner profile shape of the first end. The cord guiding insert may be mounted at the first end with the at least one insert portion inserted into the entrance with the outer shape of the at least one insert portion fitting with the at least part of the inner profile shape to engage the cord guiding insert to the first end. The base may be configured, with the cord guiding insert mounted at the first end and with the at least one insert portion inserted into the entrance, partially to close the entrance to define a cord opening between a first side of the base and the inner profile shape. The outer surface of the base may define a channel extending from the first side of the base to an opposite second side of the base whereby, with the cord guiding insert engaged to the first end, a cord may be guided out of the inner space, through the cord opening and along the channel defined by the outer surface of the base.

According to the present invention, there may also be provided a method of securing a movable rail of an architectural covering adjacent an end surface of the architectural structure which is substantially parallel with the movable rail. The method may include providing an end stop having magnetic material for attachment to the surface of the architectural structure. The method may include providing for inclusion in the movable rail a retention member having magnetic material and for securing the rail to the end stop. The method may include providing a cord guiding insert to be mounted at an end of the movable rail and defining a cord opening into the movable rail. The method may include providing the cord guiding insert and the retention member as a single unit to be mounted at the end of the movable rail.

There may also be provided a method of guiding at least one cord out of the end of a movable rail of an architectural covering. The method may include providing a cord guiding insert for mounting in a first end of the movable rail. The method may include providing the cord guiding insert with a base having an outer surface and an inner surface opposite to the outer surface and having at least one insert portion extending from the inner surface. The method may include matching the outer shape of the at least one insert portion with at least part of the inner profile shape of the first end of the movable rail and mounting the cord guiding insert at the first end of the movable rail by inserting the at least one insert portion into the first end. The method may include arranging the base to partially close the entrance defined by the movable rail at the first end so as to define a cord opening between a first side of the base and the inner profile shape. The method may include defining in the outer surface of the base a channel extending from the first side of the base to an opposite side of the base whereby, with the cord guiding insert mounted to the first end, a cord is guided out of the movable rail, through the cord opening and along the channel defined by the outer surface of the base.

Embodiments will be more clearly understood from the following description, given by way of example only, with reference to the accompanying drawings, in which.

Figure 1:
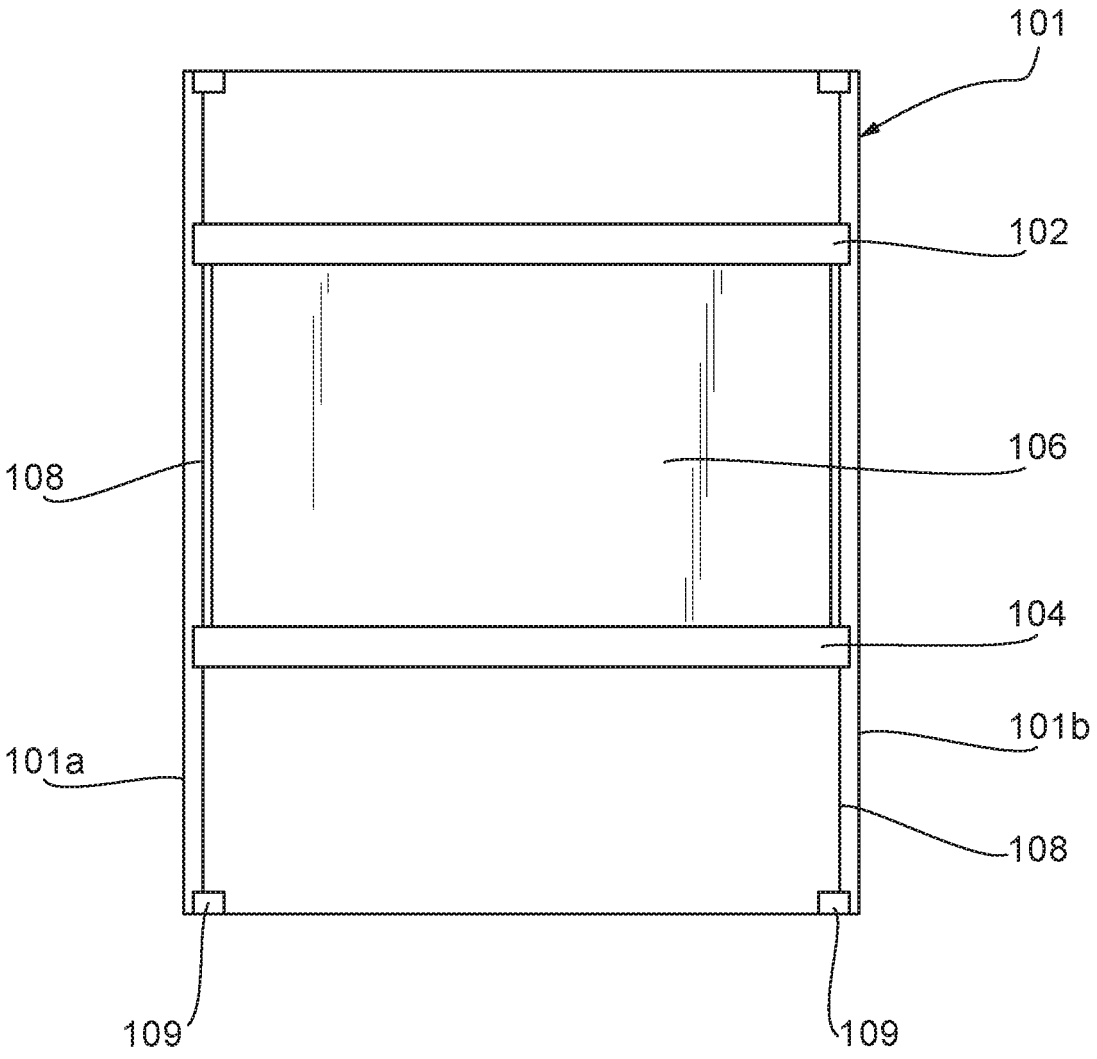
FIG. 1 illustrates an installed architectural covering.

There is provided a rail for use as a movable rail in an architectural covering wherein the rail includes a first end and wherein the rail extends in a first direction from the first end and wherein the rail includes a cord guiding insert for mounting at the first end. At the first end, the rail has a cross-section with an inner profile shape defining an entrance into the rail. The rail defines an inner space extending in the first direction from the entrance and for receiving a cord. The cord guiding insert includes a base with an outer surface and an inner surface opposite to the outer surface. The cord guiding insert includes at least one insert portion extending from the inner surface of the base. The at least one insert portion has an outer shape matching at least part of the inner profile shape of the first end. The cord guiding insert is mounted at the first end with the at least one insert portion inserted into the entrance with the outer shape of the at least one portion fitting with the at least part of the inner profile shape to engage the cord guiding insert to the first end. The cord guiding insert defines a cord opening extending into the entrance. The rail may include a retention member having magnetic material for securing magnetically the rail to an end stop of the architectural covering. The cord guiding insert and the retention member form a single unit mounted at the first end.

In this way, it is not necessary to provide dedicated mounting parts for the magnetic material of the retention member. For example, it is not necessary to screw or rivet a part containing magnetic material to the rail. The magnetic material of the retention member may be mounted to the rail together with the cord guiding insert. Furthermore, the magnetic material is, in this way, provided closer to the far end of the rail.

Although it would be possible to provide the cord guiding insert and the retention member as a single moulding holding magnetic material, preferably, the cord guiding insert is configured to engage with the retention member and to engage the retention member at the first end of the rail.

In assembly, the cord guiding insert and retention member could be assembled together to form the single unit and then be mounted to the first end. Alternatively, the cord guiding insert could be mounted at the first end of the rail and then the retention member be moved into engagement with the cord guiding insert to form the single unit.

The cord guiding insert may include at least one support member extending from the inner surface with a support surface configured to support the retention member in a second direction perpendicular to the first direction. Usefully, the insert may be used with a horizontally orientated movable rail with the support surface supporting the retention member at least vertically (against gravity). The retention member is positionable on the support surface. It may be moveable on the support surface, for example, slidable on the support surface towards the inner surface of the base. The cord guiding insert may include a lip extending from the inner surface with a lip surface facing in a direction towards the support surface. In other words, in a practical implementation, the lip may face downwardly. The retention member may include a proximal end configured to engage with the lip surface of the lip such that the proximal end is supported in a direction opposite to the second direction. In other words, when the retention member is slid towards the inner surface of the face whist resting upon the support surface, the proximal end engages under the lip so as to hold the proximal end against the support surface.

The support member and the retention member may be configured to cooperate with each other to support the retention member in opposite third directions perpendicular to the first and second directions. In a practical embodiment, this cooperation, for example cooperating shapes and dimensions, prevent the retention member from moving side-to-side with respect to its sliding movement in the first direction.

Any appropriate cooperating surfaces may be used, for example with portions of the retention member extending on either side of one or more support members of the cord guiding insert. However, in one preferred arrangement, the support member includes two substantially parallel support rails together forming the support surface. The retention member may then have a profile dimensioned to fit against both rails for supporting in the second direction and between respective rails for supporting in the opposite third directions. In other words, in a practical embodiment, the retention member may rest on top of the support surface formed by the two support rails and be prevented from moving side-to-side by fitting between those two support rails.

The support member may include an engagement member configured to engage with and support a distal end of the retention member, opposite the proximal end, in the direction opposite to the second direction. Thus, in the same way that the lip holds the retention member against the support surface at the distal end, the engagement member holds the retention member against the support surface at the distal end.

The support member may include an arm extending from the inner surface of the base to an end part. The arm may be configured to extend in the first direction on the same side of the retention member as the support member and may include the engagement member at the end part.

By providing the engagement member as part of the arm on the same side of the retention member as the support member, it becomes possible to locate the retention member to the far side of the rail with respect to the support member.

Thus, the magnetic material of the retention member can be located close to or at the end of the rail so as to ensure a good magnetic connection with the end stop of the architectural covering.

Various engagement members may be provided at the end part for preferably resiliently engaging with the retention member. For example, the engagement member could include a protrusion for insertion into an aperture, for instance in an end face of the retention member. However, in one preferred embodiment, the engagement member includes an aperture. The retention member may include a latch member at the distal end configured to extend in the direction opposite to the second direction. The aperture may be configured to engage with the latch member and to support the distal end in the direction opposite to the second direction. In this way, in a practical embodiment, the latch member may extend down through the aperture in the arm and thereby latch with the arm to hold the retention member down on the support surface.

The base may be configured, with the cord guiding insert mounted at the first end and with the at least one insert portion inserted into the entrance, partially to close the entrance to define a cord opening between a first side of the base and the inner profile shape. The outer surface of the base may define a channel extending from the first side of the base to an opposite second side of the base whereby, with the cord guiding insert engaged to the first end, a cord may be guided out of the inner space, through the cord opening and along the channel defined by the outer surface of the base.

Thus, there may also be provided a rail for use as a movable rail in an architectural covering wherein the rail includes a first end and extends in a first direction from the first end to an opposite second end. The rail also includes a cord guiding insert for mounting at the first end. At the first end, the rail has a cross-section with an inner profile shape defining an entrance into the rail. The rail defines an inner space extending in the first direction from the entrance and for receiving a cord. The cord guiding insert includes a base with an outer surface and an inner surface opposite to the outer surface. The cord guiding insert includes at least one insert portion extending from the inner surface of the base. The at least one insert portion has an outer shape matching at least part of the inner profile shape of the first end. The cord guiding insert is mounted at the first end with the at least one insert portion inserted into the entrance with the outer shape of the at least one portion fitting with the at least part of the inner profile shape to engage the cord guiding insert to the first end. The base is configured to, with the cord guiding insert mounted at the first end and with the at least one insert portion inserted into the entrance, partially close the entrance to define a cord opening between a first side of the base and the inner profile shape. The outer surface of the base defines a channel extending from the first side of the base to an opposite second side of the base whereby, with the cord guiding insert engaged to the first end, a cord may be guided out of the inner space, through the cord opening, and along the channel defined by the outer surface of the base.

In this way, it is not necessary to thread cords through respective openings formed in the base of the cord guiding insert. In contrast, the cord or cords may already be provided along the rail before fitment of the cord guiding insert. Because insertion of the cord guiding insert into the end of the rail forms, with the inner profile shape of the rail, the cord opening, the cord guiding insert may be inserted into the first end of the rail with the cord or cords already in place in the rail. Furthermore, because the cord guiding insert itself does not require holes therethrough, moulding of the cord guiding insert is simplified.

The at least one insert portion may extend substantially perpendicular to the inner surface. Also, the inner surface and the outer surface may be substantially parallel. Such an arrangement will be useful for the rails having ends substantially perpendicular to the elongate extent of the rails.

The outer surface of the base may define an additional channel extending from the first side to the second side for guiding an additional cord respectively. In this respect, often, multiple cords will be provided in the rail. By providing corresponding multiple channels, the cords may be kept from interfering from one another.

The base may include a wall between and defining the channel and the additional channel. Of course, multiple walls may be provided where more channels are provided. The wall may extend beyond the first side at least partly across the cord opening so as to define the respective cord paths through the cord opening. In particular, as cords pass from the rail around into respective channels, the extending wall or walls may assist in separating the cords and preventing interference between one another.

In one arrangement, the wall or walls may extend across the opening to meet with the inner profile shape. In this way, the wall or walls will form completely separate respective cord openings.

The rail may include at least a base wall extending in the first direction and a second direction perpendicular to the first direction and may include, at two substantially opposite edges of the base wall in the second direction, respective side walls extending in the first direction and in substantially a third direction perpendicular to the first and second directions. In other words, the wall may have a generally U-cross section perpendicular to the elongate extent, though may be provided with additional portions at least partially closing the open "U". The base wall and the two side walls may form the cross section with the inner profile shape defining the entrance. The base of the cord guide insert defines the cord opening with the base wall by leaving a space in the third direction. In this way, the channel or channels in the base may be provided so as to extend from the first side to the second side substantially in the third direction. In other words, in a practical embodiment, the cord or cords may extend out of the rail along one side of that rail (against its face) and then traverse across the cross-section of the rail guided by the channel or channels.

Although the at least one insert portion could be provided as a single portion for insertion into a single profile/aperture in the end of the rail, in one preferred embodiment, the at least one portion includes a plurality of insert portions extending from different parts of the inner surface and configured to fit with different respective parts of the inner profile shape. The different respective insert portions may be provided towards opposite sides of the inner surface to fit with different outer parts of the inner profile shape of the rail and so as to provide good stability between the cord guiding insert and the end of the rail whilst minimising weight and use of material.

An end cap may be provided to fit to the first end of the rail to cover the cord guiding insert. One or both of the cord guiding insert and the first end of the rail may define at least one opening for receiving a corresponding protrusion of the end cap to engage it in place.

There may also be provided architectural covering including at least one rail as explained above with a cord guiding insert. The rail is arranged to be mounted movably across an architectural structure and configured to extend and retract a shade.

The architectural covering may include one or more cords extending along and out of the inner space, through the cord opening, and along the channel or channels defined by the outer surface of the base.

The architectural covering may include one or more end stops including magnetic material. The end stops may be configured to be mounted to a surface of the architectural structure which is parallel with the rail. In this way, the one or more end stops may act to engage the rail against that surface.

There is also provided a method of securing a movable rail of an architectural covering adjacent an end surface of the architectural structure substantially parallel with the movable rail. The method includes providing an end stop having magnetic material for attachment to the surface of the architectural structure. Such an end stop may be provided at the two opposite ends of the end surface. The method includes providing in the movable rail a retention member having magnetic material and for securing the rail to the end stop. A retention member is provided for each end of the movable rail. The method includes providing a cord guiding insert mounted at an end of the movable rail and defining a cord opening into the movable rail. The cord guiding insert and the retention member are provided as a single unit to be mounted at the end of the movable rail. A second cord guiding insert and retention member may be provided as a second single unit to be mounted at a second end of the movable rail.

There is also provided a method of guiding at least one cord out of the end of a movable rail of an architectural covering. The method includes providing a cord guiding insert for mounting in a first end of the movable rail and providing the cord guiding insert with a base having an outer surface and an inner surface opposite to the outer surface and having at least one insert portion extending from the inner surface. The outer shape of the at least one insert portion is matched with at least part of the inner profile shape of the first end of the movable rail and the cord guiding insert is mounted at the first end of the movable rail by inserting the at least one insert portion into the first end. The base is arranged to partially close the entrance defined by the movable rail at the first end so as to define a cord opening between a first side of the base and the inner profile shape. In the outer surface of the base, a channel is defined extending from the first side of the base to an opposite side of the base whereby, with the cord guiding insert mounted to the first end, a cord is guided out of the movable rail, through the cord opening and along the channel defined by the outer surface of the base.

The rail may be embodied in an architectural covering for example as illustrated schematically in FIG. 1.

The architectural covering may be fitted to an architectural structure 101 and includes an upper movable rail 102 and a lower movable rail 104. A shade 106 of any appropriate form extends between the upper movable rail 102 and the lower movable rail 104. The shade 106 may take form of a roman shade, a venetian blind, a cellular structure etc. Each of the upper movable rail 102 and lower movable rail 104 is movable across the architectural structure 101 towards and away from a respective edge. As the upper movable rail 102 and lower movable rail 104 move towards each other, the blind 106 is retracted, for example by concertina or rolling action. When the upper movable rail 102 and lower movable rail 104 are moved apart, the shade 106 is extended across the architectural structure 101.

So that the movable rails 102 and 104 are retained at the position where they are placed (by a user), a known cord tensioning system may be provided. For example, as illustrated, cords 108 extend parallel to the side edges of the architectural structure 101 and along the respective movable rails 102, 104.

The cords 108 are held in place with respect to the upper and lower sides of the architectural structure 101 by means of cord mounts that are engaged to those edges of the architectural structure 101.

It should be appreciated that these features are also applicable to an arrangement with either the upper or lower rail fixed to the edge of the architectural structure and the other of the upper and lower rails movable.

For ease of description, the upper movable rail 102 will be considered in the following example. However, it will be appreciated that the same features, with opposite orientation, can also be considered for the lower movable rail 104.

Figure 2:
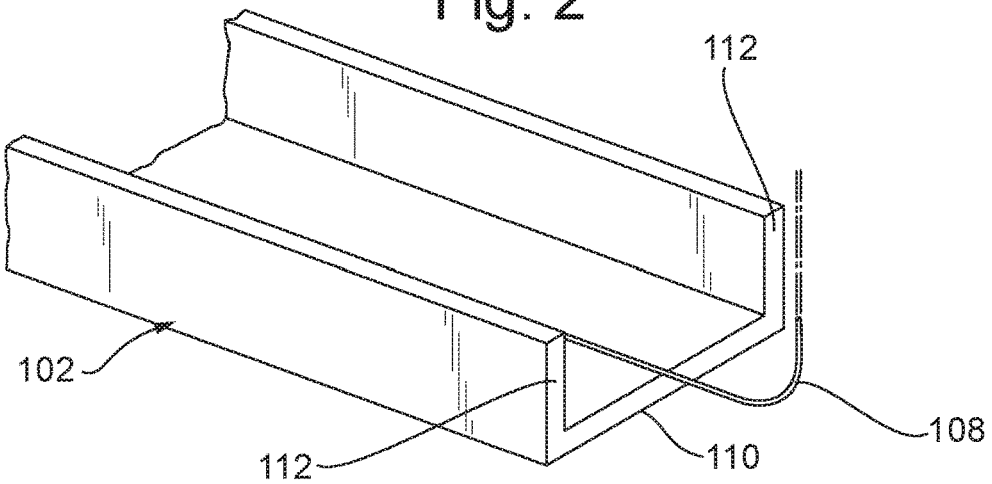
FIG. 2 illustrates the rail of an architectural covering.

The rail 102 has an elongate extent in a first direction which, as illustrated, is horizontal. The rail has a base wall 110. At the two opposite edges of the base wall 110 respective side walls 112 extend substantially perpendicular to the base wall 110. This is illustrated schematically in FIG. 2. Although not illustrated, the rail 102 may be further formed to at least partially fill the space opposite the base wall 110 so as to further enclose the elongate space within the rail 102.

As noted above, in use, a cord 108 extends along the length of the rail 102. The base wall 110 and side walls 112 define an entrance to the internal space of the rail 102. The cord 108 extends into and out of the rail via the entrance and may then extend perpendicular to the rail along the side edges 101*a*, 101*b* of the architectural structure 101.

Figure 3:
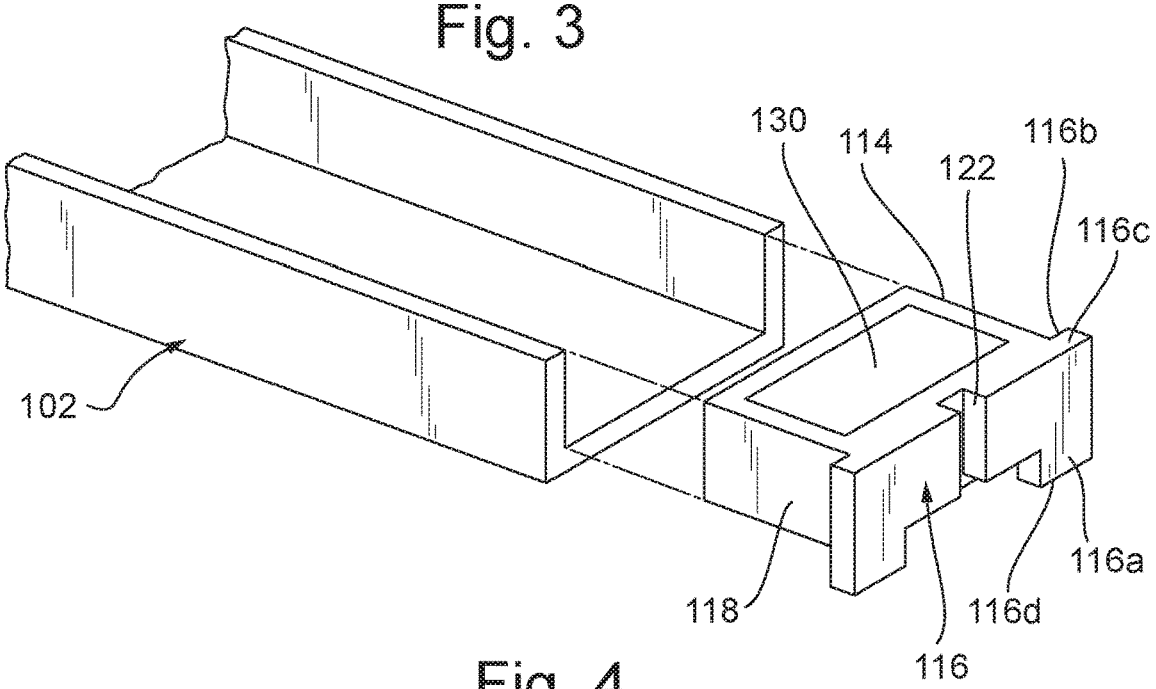
FIG. 3 illustrates a cord guiding insert for insertion into a rail.

In order to guide appropriately the cord 108, there is provided a cord guiding insert 114 as illustrated in FIG. 3. As illustrated, the cord guiding insert includes a base 116 with an outer surface 116*a* and an inner surface 116*b*. The outer surface 116*a* faces outwardly of the assembly away from the longitudinal extent of the rail 102 and may be covered by an end cap to be described later. The inner surface 116*b* faces inwardly of the assembly towards the inner space of the rail 102. As illustrated, an upper surface 116*c* faces upwardly in the same direction as the open side of the rail 102 and a lower surface 116*d* faces downwardly in the same direction as the closed side of the rail 102. An insert portion 118 extends from the inner surface 116*b* and has a shape and dimensions to match at least part of the inner profile formed in the end of the rail 102. In this way, the cord guiding insert 114 may be mounted at the end of the rail 102 by inserting the insert portion 118 into the entrance formed at the end of the rail 102.

Figure 4:
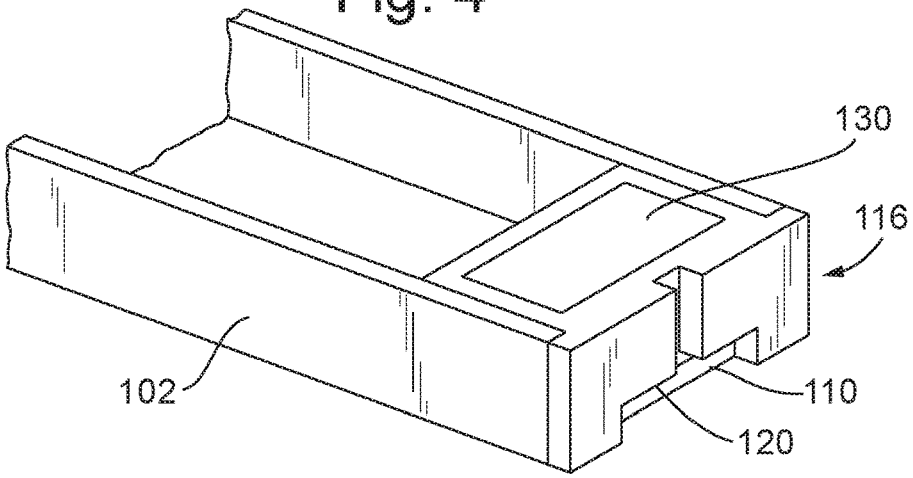
FIG. 4 illustrates a cord guiding insert inserted into the rail.

As illustrated in FIG. 4, with the cord guiding insert 114 mounted at the end of the rail 102, the base 116 partially closes the entrance of the rail 102, but leaves a space 120 between the base 116 of the cord guiding insert 114 and the base wall 110 of the rail 102. This space forms a cord opening out of which the cord 108 may extend. As illustrated in FIG. 3 and FIG. 4, the outer surface of the base 116 also defines a channel 122 which extends from one side of the base 116 to another. In particular, the channel 122 extends from the cord opening 120 to guide the cord generally perpendicularly to the extent of the rail 102 and along the edge of the architectural structure when fitted.

Figure 5:
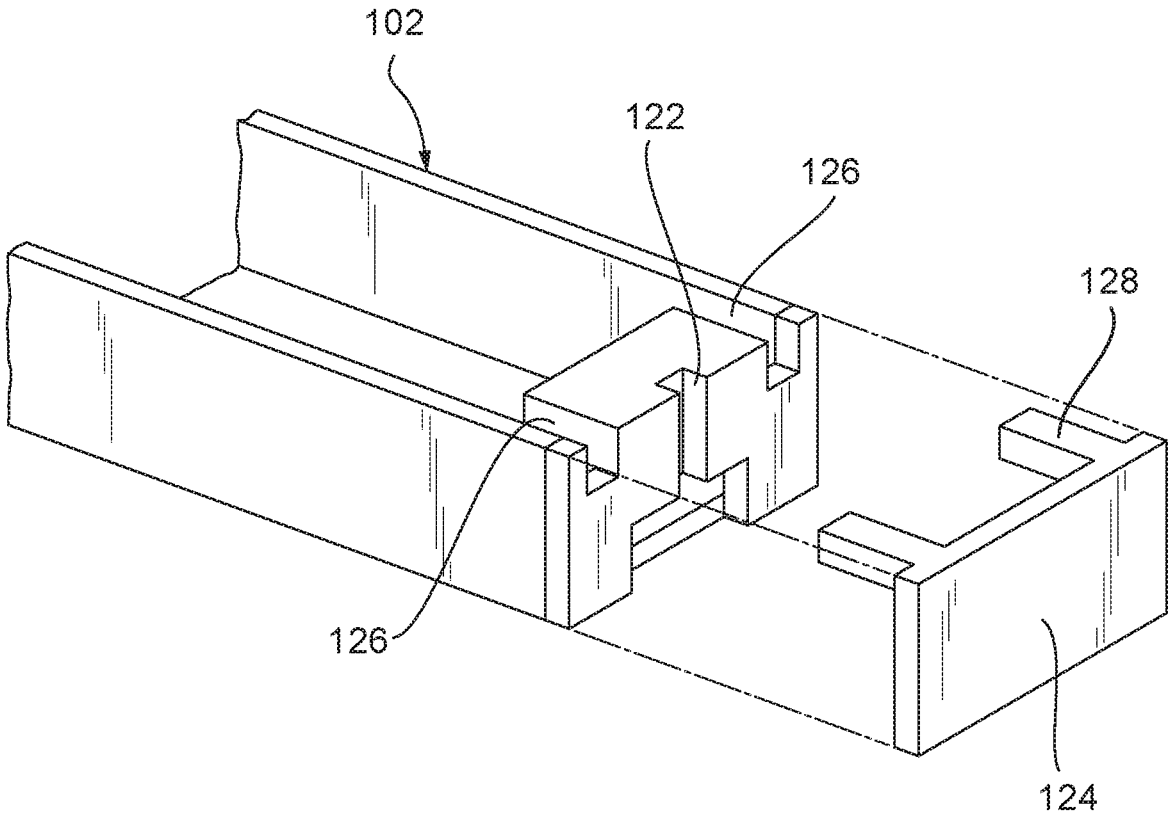
FIG. 5 illustrates an end cap for insertion to the cord guiding insert and rail.

It is possible also as illustrated in FIG. 5 to fit an end cap 124 to the rail 102.

Appropriate openings 126 may be formed at the end of the rail 102 either from the rail 102, the cord guiding insert 114 or a combination thereof. The cap 124 is then mounted to the end of the rail 102 by inserting correspondingly shaped protrusions 128. In this way, the cap closes the outer opening of the channel 122 to provide a closed passageway for the cord 108.

Returning to the architectural covering described with reference to FIG. 1, plates of magnetic material are preferably provided in or adjacent the cord holders 109. Corresponding magnetic material parts may be provided in the movable rails 102, 104 to magnetically engage those respective rails at the sides of the architectural structure. This is particularly advantageous for the upper movable rail where the magnets may ensure that it is held against the top of the architectural structure. For example, with operation of the lower rail, the tension cords 108 may lose some of their tension, which would otherwise allow the top movable rail 102 to move slightly downwards.

In the embodiment illustrated in FIG. 3, a retention member 130 having magnetic material is provided with the cord guiding insert 114 as a single unit. In this way, during assembly, it is not necessary to attach separately a retention member to the rail 102. Furthermore, it becomes possible to locate the retention member 130 closer to the end of the rail 102.

It should be noted that the retention member could similarly be provided as a single unit with a cord guiding insert having a different configuration for guiding the cord 108 out of the rail 102, for example including at least one through hole between the inner and outer surfaces of the base 116 of the cord guiding insert 114, rather than the open space at the lower portion of the base 116 as discussed above.

Figure 6:
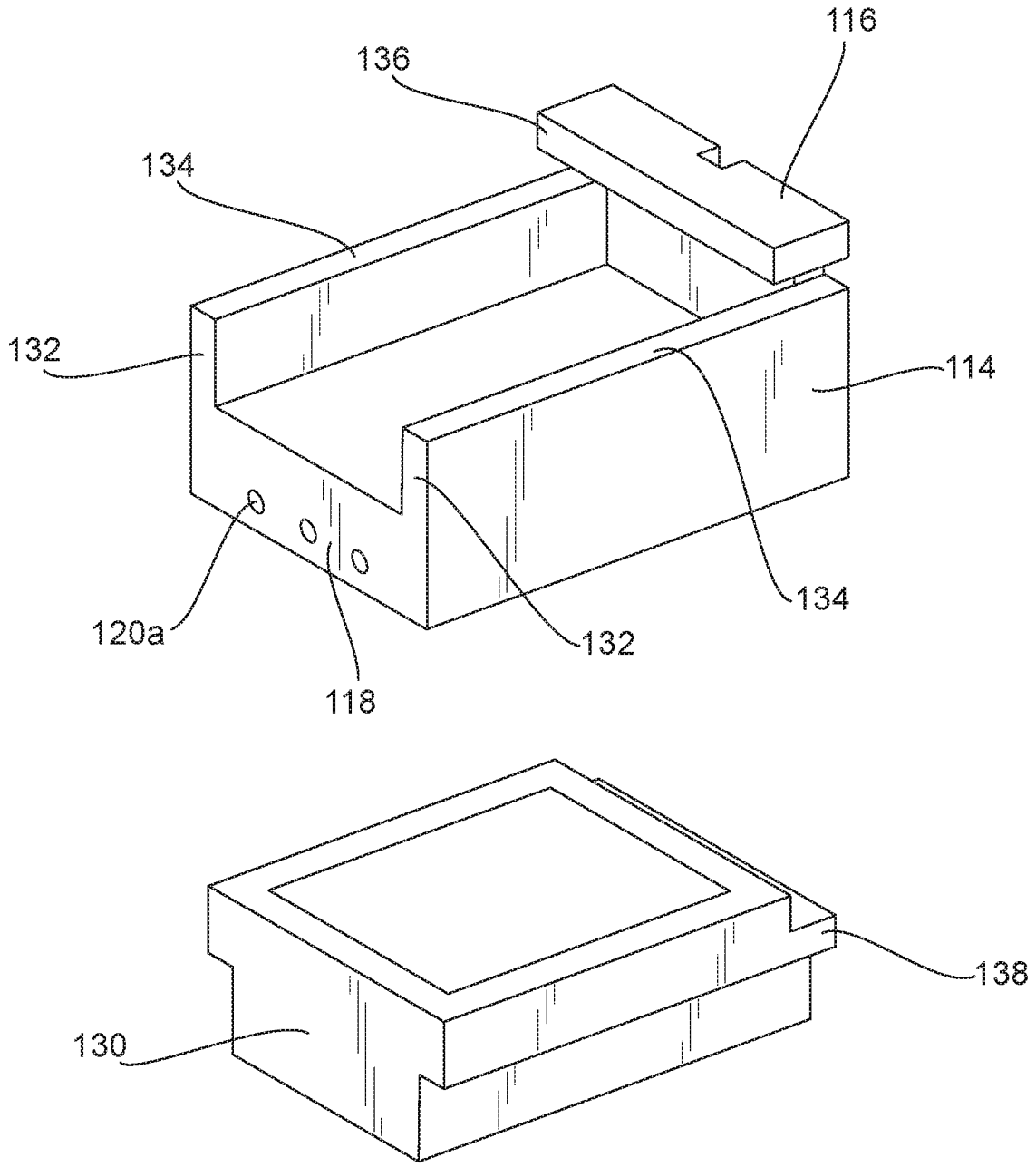
FIG. 6 illustrates a retention member with a cord guiding insert.

The embodiment illustrated in FIG. 6 includes such through holes 120*a*. It also includes a cord guiding insert 114 with two support members 132 extending from the inner surface of the base 116. In the illustrated embodiment, these are formed as part of the insert portion 118, but, in other embodiments, they could be formed separately.

The two support members 132 together define a support surface 134 for supporting a retention member 130. In particular, for a rail used as an upper movable rail 102, in use, the support surface 134 provided by the two support members 132 faces upwardly and the retention member 130 may rest on that support surface.

As illustrated, the base 116 is provided with an overhanging and inwardly facing lip 136. The retention member 130 has a proximal end for location towards the end of the rail 102 and this proximal end is configured with a feature 138 to fit under the lip 136 of the base 116. In this way, the proximal end of the retention member 130 is engaged in a direction opposite to the support offered by the support surface 134 and the retention member 130 is held in place. With the retention member 130 and cord guiding insert 114 engaged with each other in this way, they can then be mounted as a single unit at the end of the rail 102.

Figure 7:
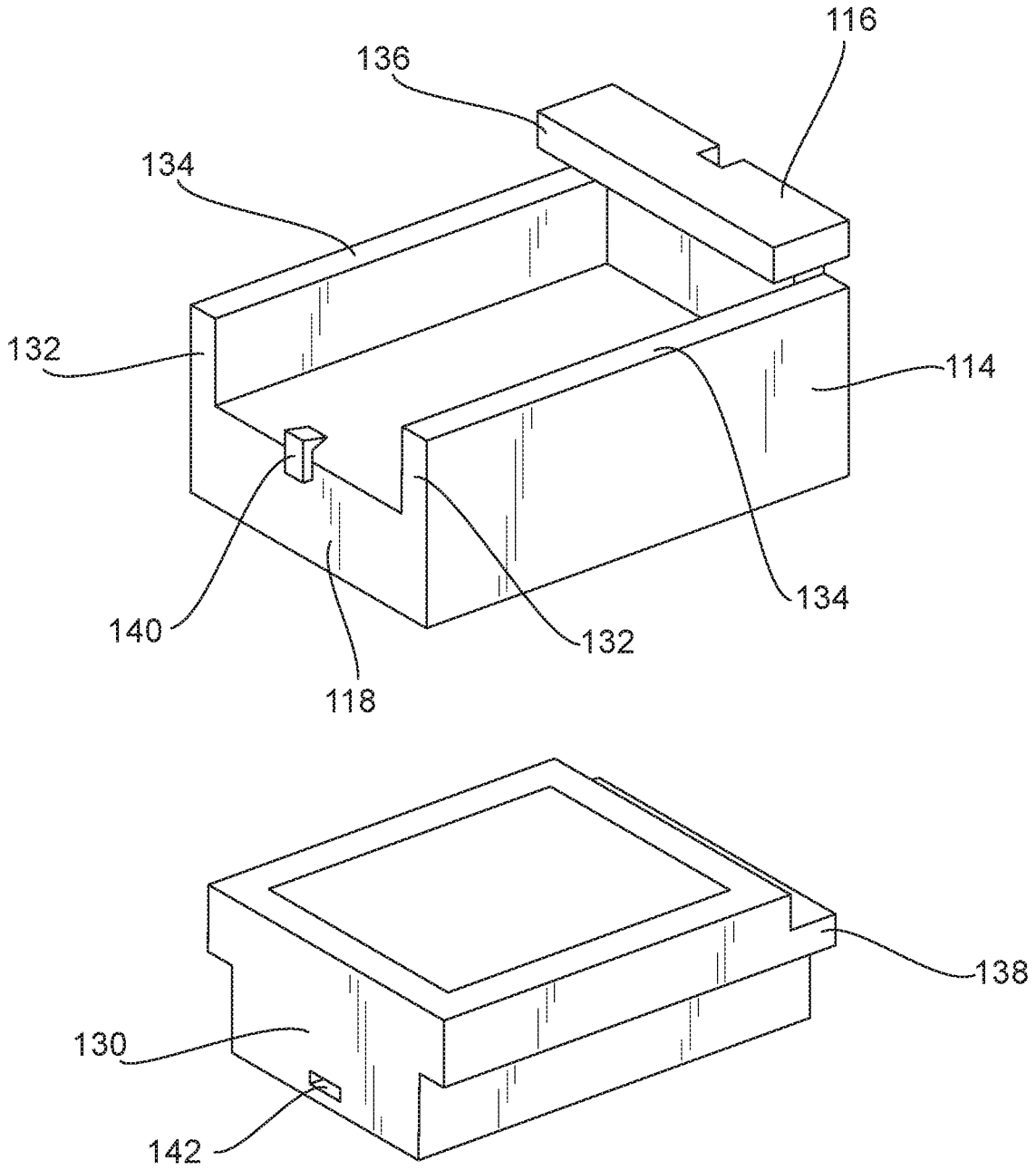
FIG. 7 illustrates an alternative retention member with a cord guiding insert.

As illustrated in FIG. 7, it is possible to further engage the retention member 130 to the cord guiding insert 114. In this respect, the illustrated embodiment includes an engagement member 140 configured to engage with and support a distal end of the retention member 130. In this illustrated embodiment, the engagement member 140 includes a resilient member for engaging with a detent or opening 142 at the distal end of the retention member 130. In assembly, the retention member 130 is placed on the support surface 134, slid in the first direction against the cord guiding insert 114 so that the feature 138 is engaged under the lip 136 and then the distal end of the retention member is pushed downwardly so that the engagement member 140 engages with the detent or opening 142. As a result, both the proximal and distal ends of the retention member 130 are held securely.

An alternative embodiment including many of the features discussed above will now be described.

Figure 8:
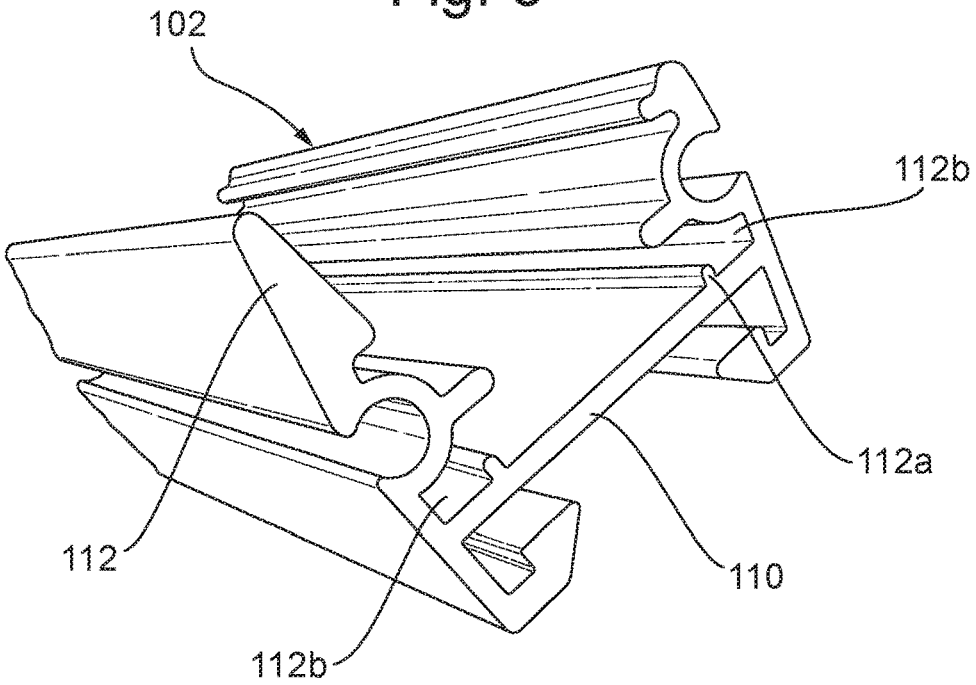
FIG. 8 illustrates an alternative rail.

In this embodiment, as illustrated in FIG. 8, the inner profile shape defined by the rail 102 is more complex, though can still be considered to include a base wall 110 with side walls 112 and to define an entrance at the end of the rail 102.

Portions 112*a* of the inner profile are configured to receive the insert portion 118 extending from the base 116 of the cord guiding insert 114.

Figure 9:
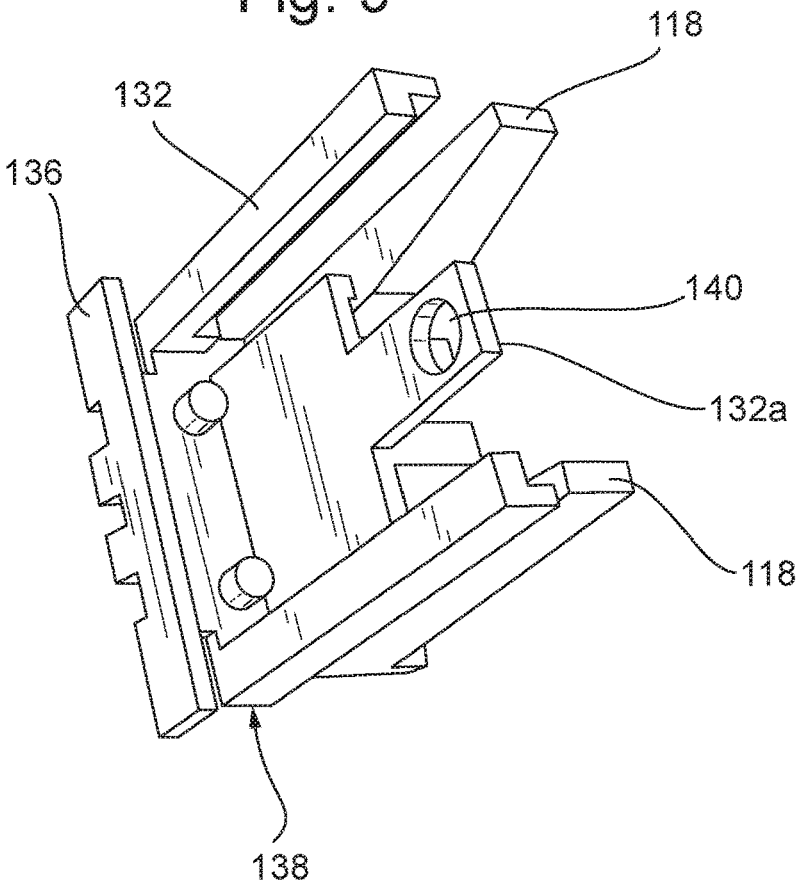
FIG. 9 illustrates a cord guiding insert.
Figure 10:
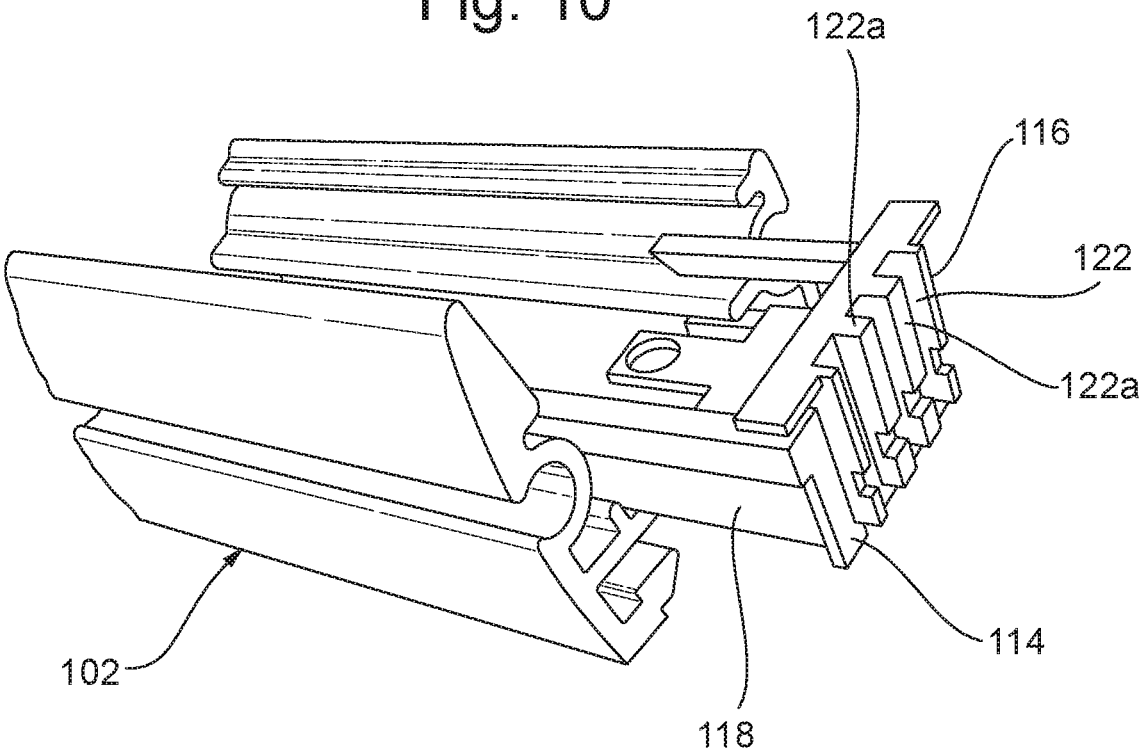
FIG. 10 illustrates the cord guiding insert for insertion into the rail.

As illustrated in FIG. 9, in this embodiment, a pair of insert portions 118 extend on opposite sides of the base 116. These are inserted into the end of the rail 102 as illustrated in FIGS. 10 and 11.

Figure 11:
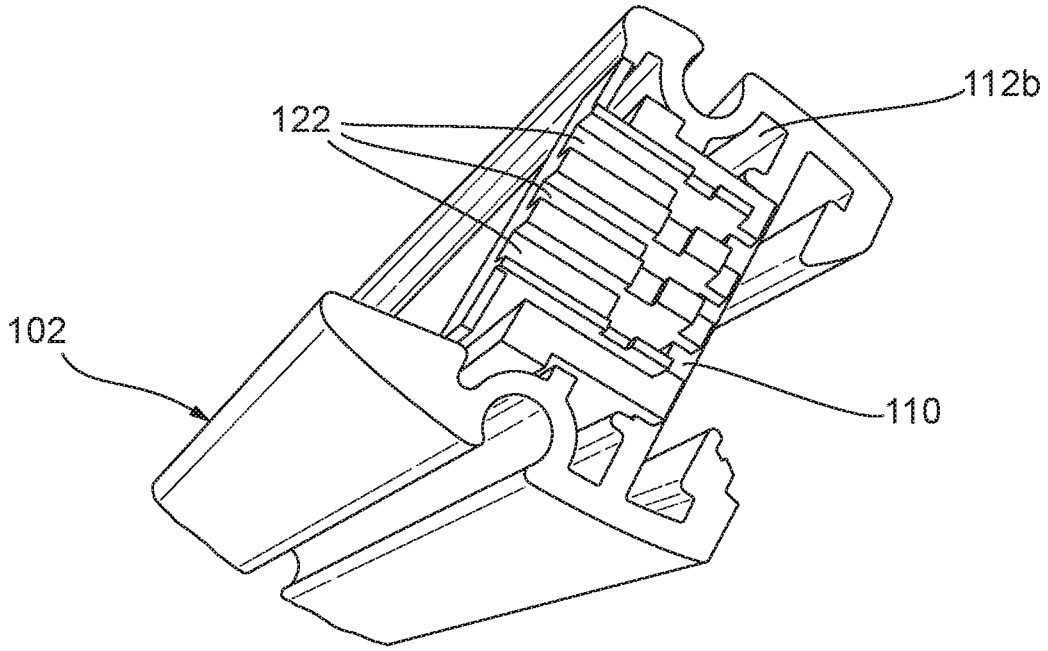
FIG. 11 illustrates the cord guiding insert inserted into the rail.
Figure 12:
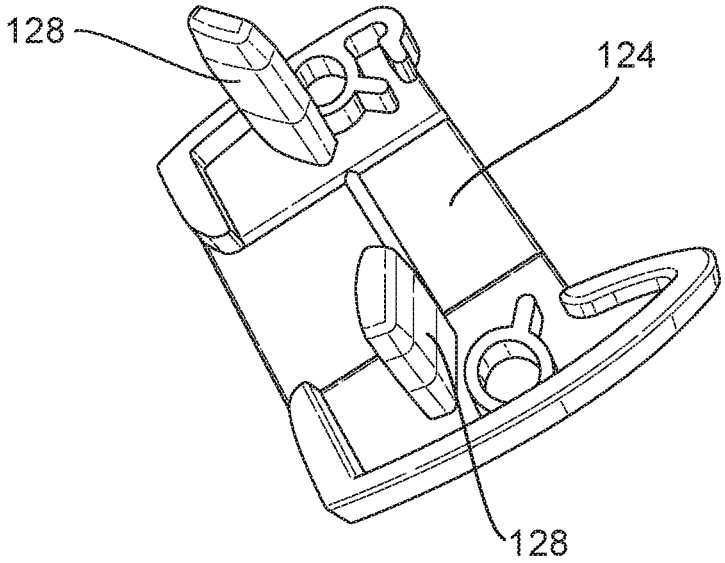
FIG. 12 illustrates an end cap.
Figure 13:
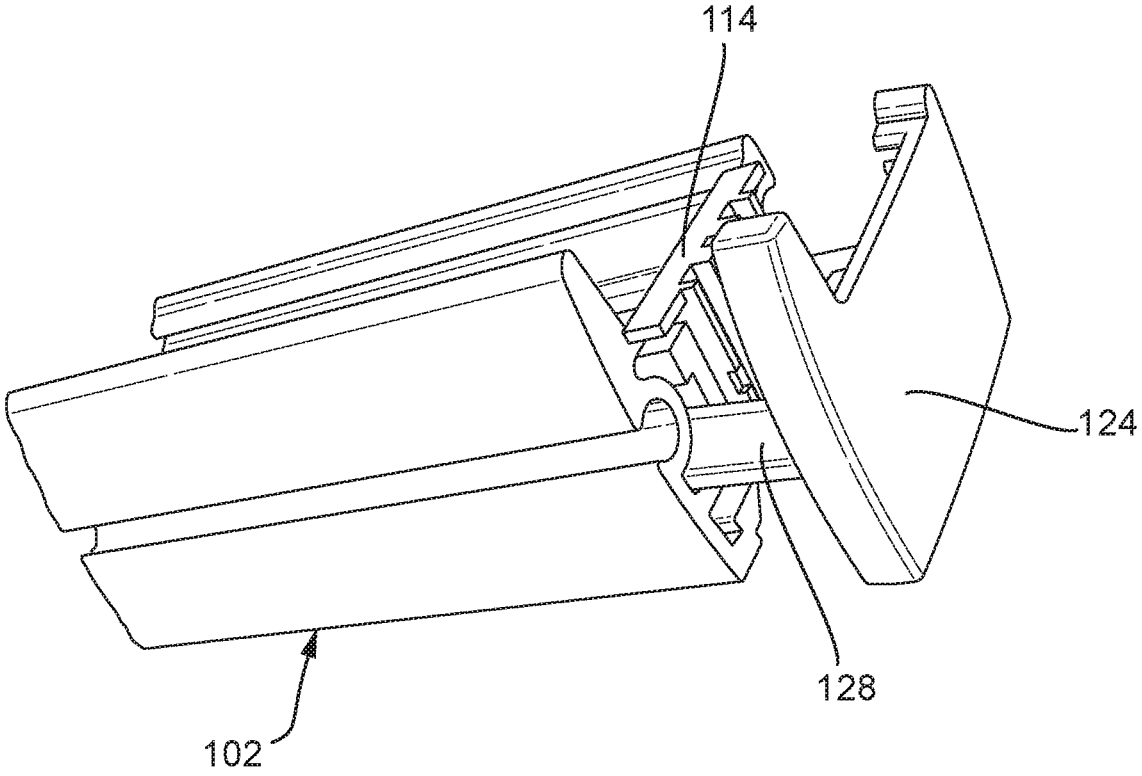
FIG. 13 illustrates the end cap for insertion into the rail.

With the cord guiding insert 114 inserted in the end of the rail 102, as illustrated in FIG. 11, part 112*b* of the inner profile either side of the cord guiding inset 114 remains open. The extending portions 128 of the end cap 124 illustrated in FIG. 12 are configured to fit into those portions 112*b* as illustrated in FIG. 13. In this way, as illustrated in FIG. 13, the end cap 124 may be mounted to the end of the rail 102 so as to cover the cord guiding insert 114.

In this illustrated embodiment, a plurality of channels 122, in particular three channels 122, are formed in the base 116 of the cord guiding insert 114. Hence, a plurality of corresponding cords may be guided by the cord guiding insert 114. Adjacent channels 122 are separated by respective walls 122*a*. In the illustrated embodiment, these walls 122*a* extend across the opening formed between the base 116 of the cord guiding insert 114 and the base wall 110 of the rail 102 and meet with the base wall 110 so as to define corresponding distinct openings for each respective channel 122. In other embodiments, it is possible for the walls 122*a* to extend only partly towards the base wall 110 so as to define guides for corresponding cords.

Figure 14:
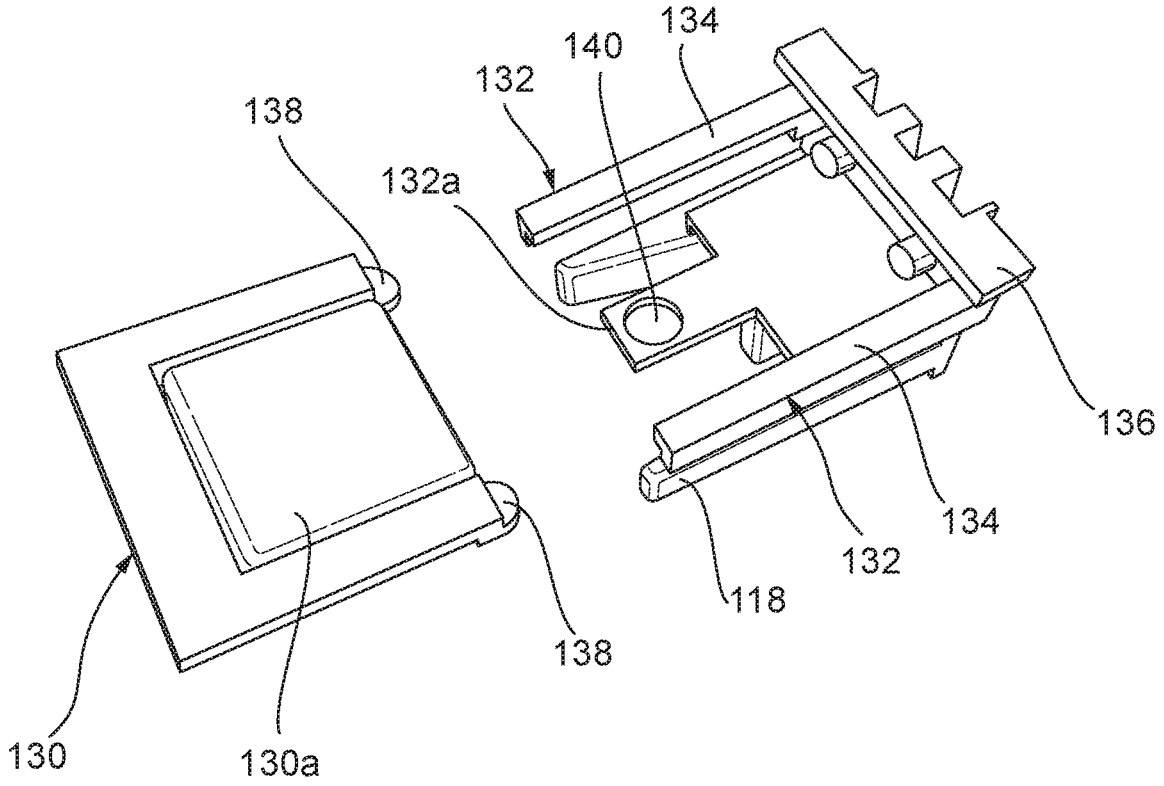
FIG. 14 illustrates a retention member with the cord guiding insert.

FIG. 14 illustrates the cord guiding insert 114 in conjunction with a retention member 130 having a magnetic material portion 130*a*.

Figure 15:
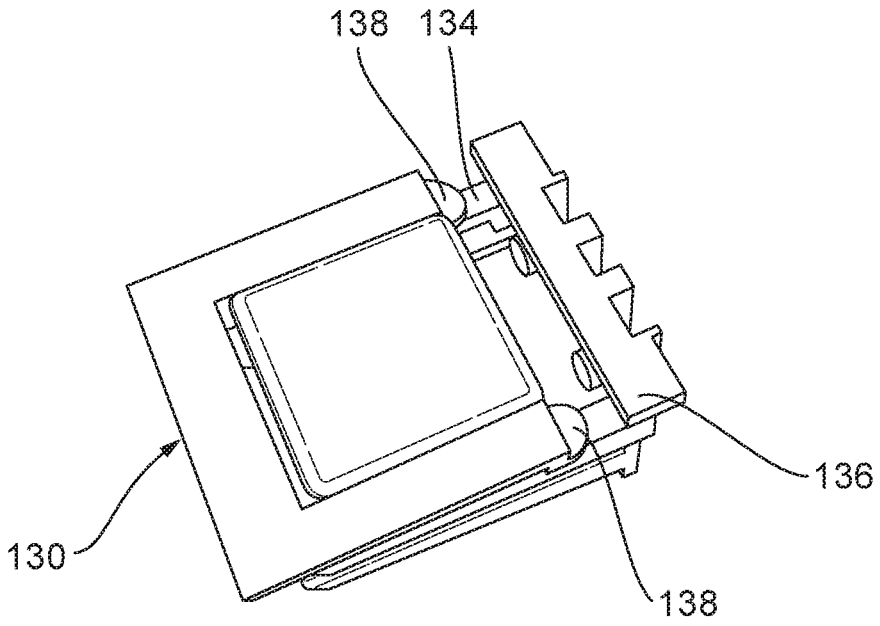
FIG. 15 illustrates the retention member being fitted to the cord guiding insert.

As illustrated, the cord guiding insert 114 includes two support members 132 on opposite respective sides of the cord guiding insert 114. Although these support members 132 are provided separately from the insert portions 118, in other embodiments, they could be formed together with the insert portions 118. Respective support surfaces 134 are formed at the upper sides (in the illustrated orientation) of the support members 132 such that, as illustrated in FIG. 15, the retention member 130 may rest upon and be supported by the support members 132.

A central portion of the retention member 130 is configured to extend between the support members 132 and has a width corresponding to the width between the support members 132. In this way, the retention member 130 is also supported from lateral movement relative to the longitudinal extent of the support members 132.

As described above, the base 116 of the cord guiding insert 114 is also provided with a lip 136 which extends inwardly of the rail. In the illustrated embodiment, at opposite respective edges of the proximal end of the retention member 130, flanges 138 are provided for extending under the lip 136. This is illustrated most clearly in FIG. 16. Thus, the retention member is held securely to the cord guiding insert 114 so as to provide a single unit.

In the illustrated embodiment, an additional support member 132*a* is provided on the cord guiding insert 114 extending substantially parallel with the two support members 132 at the sides and is configured to extend beneath the retention member 130, in other words on the side of the base wall 110 of the rail 102.

Figure 17:
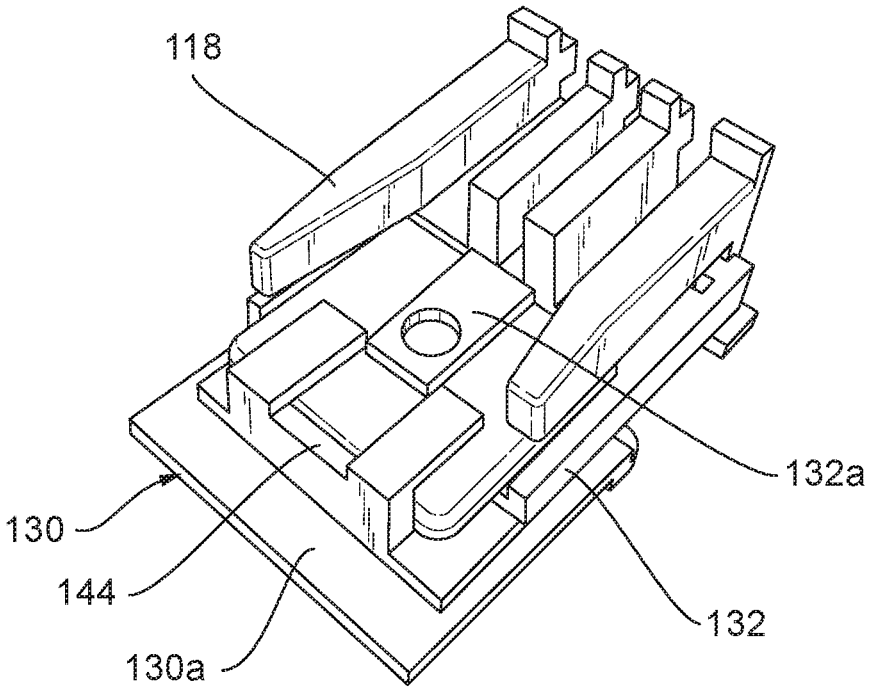
FIG. 17 illustrates, from the underside, the retention member being fitted to the cord guiding insert.
Figure 18:
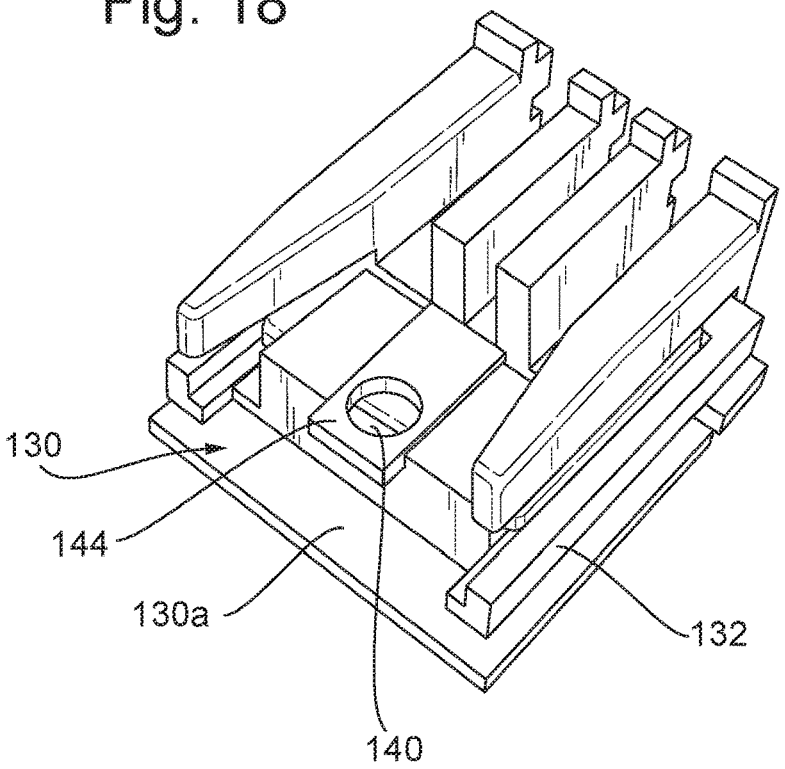
FIG. 18 illustrates, from the underside, the retention member fitted to the cord guiding insert.

Unlike the embodiment described above, in this illustrated embodiment, the engagement member is provided as an aperture 140 in the support member 132*a*. As illustrated in FIG. 17 and FIG. 18, the retention member 130 includes a latch member 144 at the distal end of the retention member 130. The latch member 144 is configured to engage the aperture 140 in the support member 132*a*. The latch member 140 may thus prevent the retention member 130 from sliding along the support surfaces 134 of the support members 132 away from the base 116 of the cord guiding insert 114. Also, in one embodiment, the latch member 144 engages the underside of the additional support member 132*a* and thereby engages the distal end of the retention member 130 from moving away from the support members 132. The retention member 130 and cord guiding insert 114 may thus be provided as a secure single unit.

Referring to FIG. 18, it will also be noted that the cord guiding insert 114 can additionally define channels running in the first or longitudinal direction of the rail so as to assist with guiding respective cords from the inner space within the rail to the cord opening formed between the cord guiding insert 114 and the rail 102.

Figure 19:
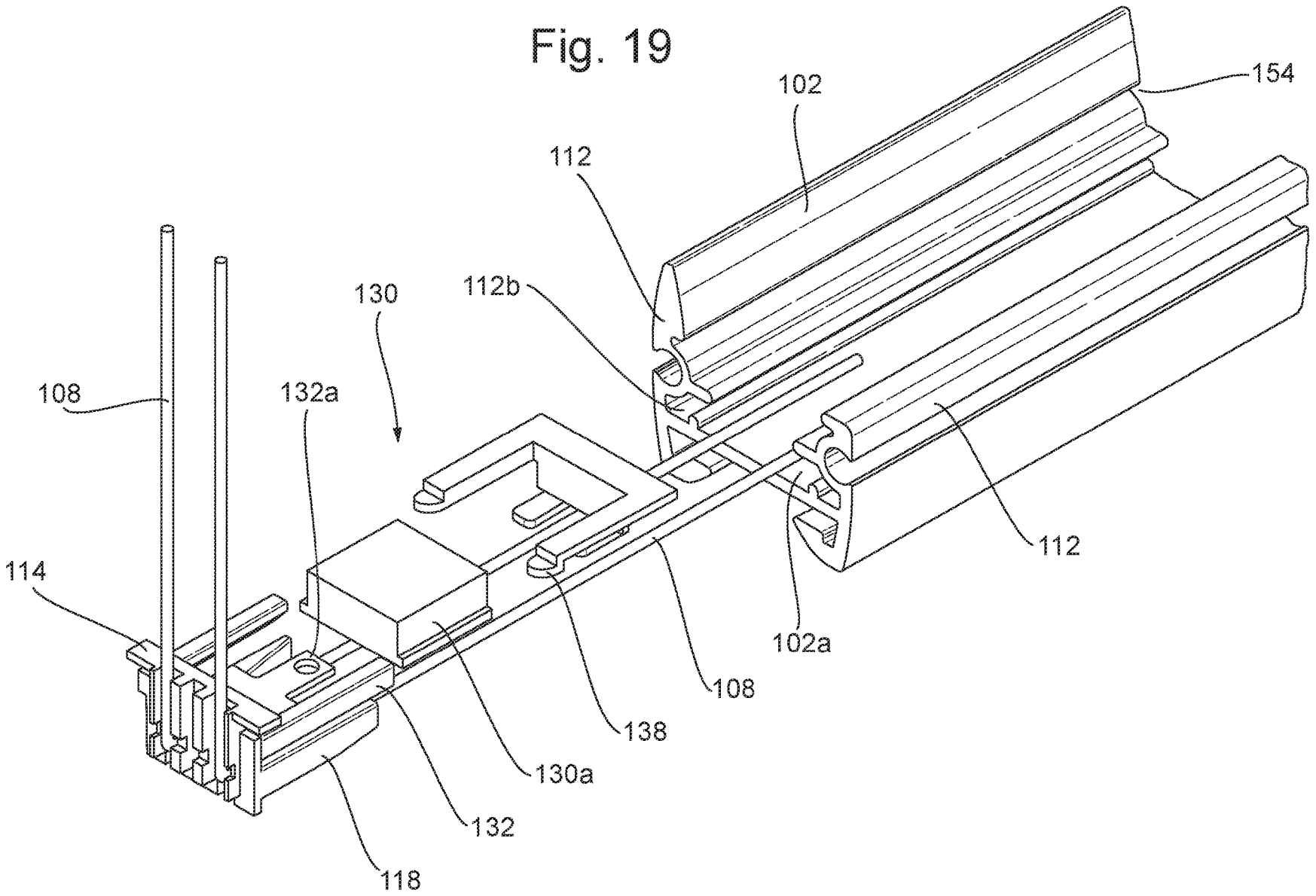
FIG. 19 illustrates component parts for assembly.

FIG. 19 illustrates all, except the end cap 124, of the above components ready for assembly together with two cords 108.

Figure 20:
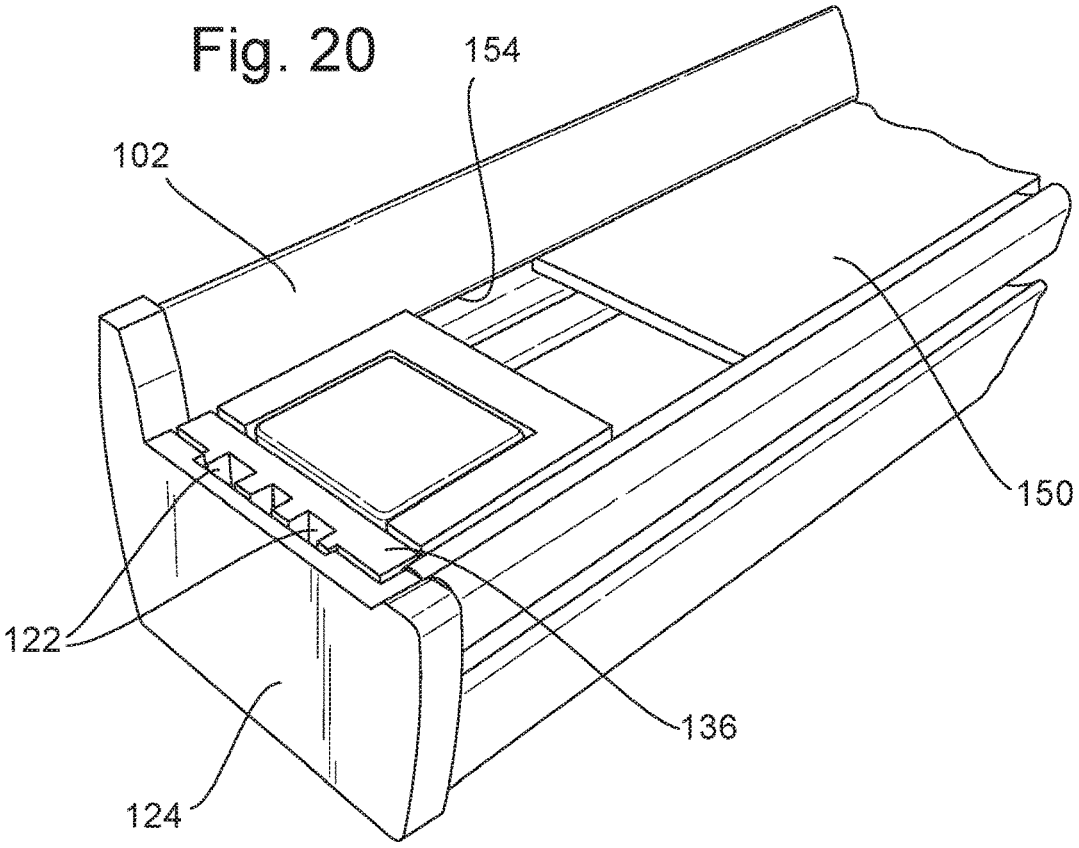
FIG. 20 illustrates the complete assembly with end cap and cover strip.

FIG. 20 illustrates a single unit of the cord guiding insert 114 and retention member 130 fitted to the end of the rail 102 with the end cap 124.

Figure 16:
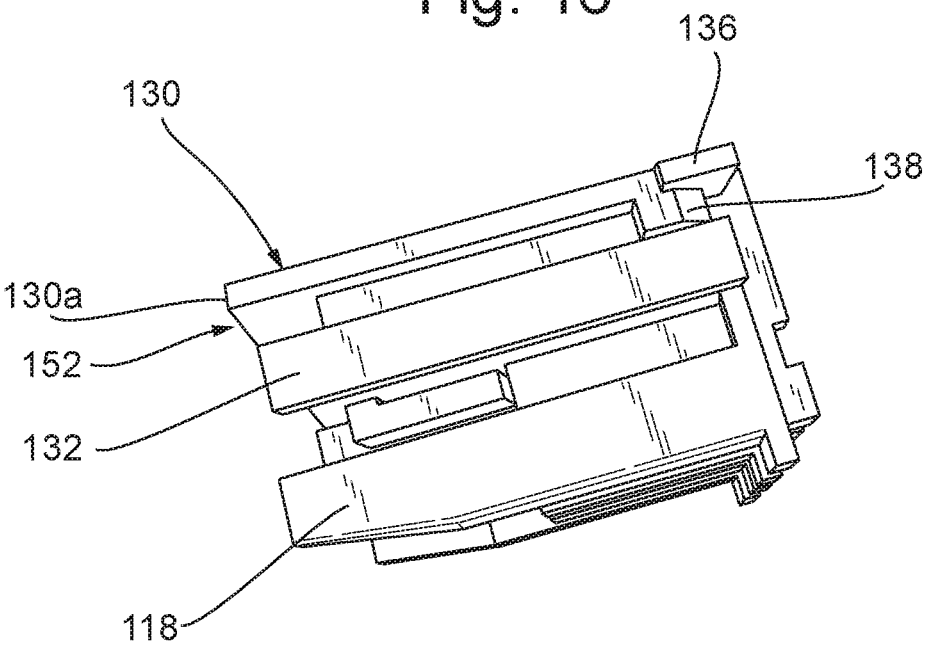
FIG. 16 illustrates the retention member fitted to the cord guiding insert.

As illustrated in FIG. 16, FIG. 17 and FIG. 18, the retention member 130 forms as overhanging lip 130*a* at a distal end opposite the flange(s) 138. Together with the support members 132, this defines a slot/opening 152 facing longitudinally along the rail 102. The rail 102 may be provided with a cover strip 150 as illustrated in FIG. 20 for covering and enclosing the inner space of the rail 102. The cover strip 150 may be slid into and along a pair of oppositely and inwardly facing grooves 154 in the side walls 112. The overhanging lip 130*a* is configured to receive an end of the cover strip 150 beneath the retention member 130 so that the cover strip 150 may engage with the surface of 134 of the support members 132. In this way, with the cover strip 150 engaged in the grooves 154, the end of the cover strip 150 acts to prevent movement of the supports members 132 and hence the cord guiding insert 114 out of the rail 102.

These and other features and advantages of the present disclosure will be readily apparent from the detailed description, the scope of the invention being set out in the appended claims.

The present disclosure is set forth in various levels of detail in this application and no limitation as to the scope of the claimed subject matter is intended by either the inclusion or non-inclusion of elements, components, or the like in the summary. In certain instances, details that are not necessary for an understanding of the disclosure or that render other details difficult to perceive may have been omitted. It should be understood that the claimed subject matter is not necessarily limited to the particular embodiments or arrangements illustrated herein.

The accompanying drawings are provided for purposes of illustration only, and the dimensions, positions, order, and relative sizes reflected in the drawings attached hereto may vary. The detailed description will be better understood in conjunction with the accompanying drawings, w Reference made in detail to embodiments of the present subject matter, one or more examples of which are illustrated in the drawings. Each example is provided by way of explanation of the present subject matter, not limitation of the present subject matter. In fact, it will be apparent to those skilled in the art that various modifications and variations can be made in the present disclosure without departing from the scope or spirit of the present subject matter. Thus, it is intended that the present subject matter covers such modifications and variations as come within the scope of the appended claims and their equivalents.

In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, counterclockwise, and/or the like) are only used for identification purposes to aid the reader's understanding of the present disclosure, and/or serve to distinguish regions of the associated elements from one another, and do not limit the associated element, particularly as to the position, orientation, or use of this disclosure.

The invention claimed is:

1. A rail for use as a movable rail in an architectural covering, wherein:

the rail includes a first end and extends in a first direction from the first end;

the rail includes a cord guiding insert for mounting at the first end;

at the first end, the rail has a cross-section with an inner profile shape defining an entrance into the rail;

the rail defines an inner space extending in the first direction from said entrance and for receiving a cord;

the cord guiding insert includes a base with an outer surface and an inner surface opposite to the outer surface, and includes at least one insert portion extending from the inner surface;

the at least one insert portion has an outer shape arranged and configured to complement at least part of the inner profile shape of the first end;

the cord guiding insert is configured to be mounted at the first end with said at least one insert portion inserted into said entrance with the outer shape of the at least one insert portion fitting with said at least part of the inner profile shape to engage the cord guiding insert to the first end and defines a cord opening to extend into the entrance;

the rail includes a retention member having magnetic material and for magnetically securing the rail to an end stop of the architectural covering; and the cord guiding insert and the retention member are coupled together for mounting as a unit at the first end;

wherein:

the base is configured to, with the cord guiding insert mounted at the first end with said at least one insert portion inserted into said entrance, partially close said entrance to define a cord opening between a first side of the base and the inner profile shape; and the outer surface of the base defines a channel extending from the first side of the base to an opposite second side of the base whereby, with the cord guiding insert engaged to the first end, a cord may be guided out of the inner space, through the cord opening and along the channel defined by the outer surface of the base.

2. The rail according to claim 1, wherein the cord guiding insert is configured to engage the retention member at the first end of the rail.

3. The rail according to claim 1, wherein the cord guiding insert includes at least one support member extending from the inner surface with a support surface configured to support the retention member in a second direction perpendicular to the first direction, the retention member is positionable on the support surface, the cord guiding insert includes a lip extending from the inner surface with a lip surface facing in a direction towards the support surface and the retention member includes a proximal end configured to engage with the lip surface of the lip such that the proximal end is supported in a direction opposite to said second direction.

4. The rail according to claim 3, wherein the support member and the retention member are configured to cooperate with each other to support the retention member in a third direction perpendicular to the first and second direction.

5. The rail according to claim 4, wherein the support member includes two parallel support rails together forming the support surface and the retention member has a profile dimensioned to fit against both support rails for support in the second direction and between respective support rails for support in the third direction.

6. The rail according to claim 3, wherein the support member includes an engagement member configured to engage with and support a distal end of the retention member, opposite the proximal end, in the direction opposite to said second direction.

7. The rail according to claim 6, wherein the support member includes an arm extending from the inner surface of the base to an end part, configured to extend in the first direction on the same side of the retention member as the support member and includes the engagement member at the end part.

8. The rail according to claim 7, wherein the retention member includes a latch member at the distal end configured to extend in the direction opposite to said second direction and the engagement member includes an aperture configured to engage with the latch member and to support the distal end in the direction opposite to said second direction.

9. A rail for use as a movable rail in an architectural covering, wherein:

the rail includes a first end and extends in a first direction from the first end;

the rail includes a cord guiding insert for mounting at the first end;

at the first end, the rail has a cross-section with an inner profile shape defining an entrance into the rail;

the rail defines an inner space extending in the first direction from said entrance and for receiving a cord;

the cord guiding insert includes a base with an outer surface and an inner surface opposite to the outer surface, and includes at least one insert portion extending from the inner surface;

the at least one insert portion has an outer shape arranged and configured to complement at least part of the inner profile shape of the first end;

the cord guiding insert is configured to be mounted at the first end with said at least one insert portion inserted into said entrance with the outer shape of the at least one insert portion fitting with said at least part of the inner profile shape to engage the cord guiding insert to the first end and with the base partially closing said entrance to define a cord opening between a first side of the base and the inner profile shape; and the outer surface of the base defines a channel extending from the first side of the base to an opposite second side of the base whereby, with the cord guiding insert engaged to the first end, a cord may be guided out of the inner space, through the cord opening and along the channel defined by the outer surface of the base.

10. The rail according to claim 9, wherein the at least one insert portion extends perpendicular to the inner surface.

11. The rail according to claim 9, wherein the inner surface and the outer surface are parallel.

12. The rail according to claim 9, wherein the outer surface of the base defines an additional channel extending from the first side to the second side for guiding an additional cord respectively.

13. The rail according to claim 9, wherein the base includes a wall between and defining the channel and the additional channel, and the wall extends beyond the first side at least partly across the cord opening so as to define respective cord paths through the cord opening.

14. The rail according to claim 13, wherein the wall extends across the opening to meet with the inner profile shape.

15. The rail according to claim 9, wherein the rail includes at least a base wall extending in the first direction and a second direction perpendicular to the first direction and includes, at two opposite edges of the base wall in the second direction, respective side walls extending in the first direction and in a third direction perpendicular to the first and second directions, and wherein the base wall and the two side walls form the cross section with the inner profile shape defining the entrance, wherein the base of the cord guide insert defines the cord opening with the base wall by leaving a space in the third direction and the channel extends from the first side to the second side in the third direction.

16. The rail according to claim 9, wherein the at least one insert portion includes a plurality of portions extending from different parts of the inner surface and configured to fit with different respective parts of the inner profile shape.

17. The rail according to claim 9, further comprising an end cap configured to fit to the first end of the rail and cover the cord guiding insert.

18. A method of securing a movable rail of an architectural covering adjacent an end surface of the architectural structure parallel with the movable rail, the method including:

providing an end stop having magnetic material for attachment to the surface of the architectural structure;

providing, for inclusion in the movable rail, a retention member having magnetic material and for securing the rail to the end stop; providing a cord guiding insert mounted at an end of the movable rail and defining a cord opening into the movable rail; and providing the cord guiding insert and the retention member as a single unit to be mounted at the end of the movable rail.

19. A method of guiding at least one cord out of a first end of a movable rail of an architectural covering, the method including:

providing a cord guiding insert for mounting in the first end of the movable rail;

providing the cord guiding insert with a base having an outer surface and an inner surface opposite to the outer surface and having at least one insert portion extending from the inner surface;

complementing the outer shape of the at least one insert portion with at least part of the inner profile shape of the first end of the movable rail and mounting the cord guiding insert at the first end of the movable rail by inserting the at least one insert portion into the first end;

arranging the base to partially close the entrance defined by the movable rail at the first end so as to define a cord opening between a first side of the base and the inner profile shape; and defining, in the outer surface of the base, a channel extending from the first side of the base to an opposite side of the base whereby, with the cord guiding insert mounted to the first end, a cord is guided out of the movable rail, through the cord opening and along the channel defined by the outer surface of the base.

* * * * *